United States Patent [19]
Ferri et al.
[11] 4,318,206
[45] Mar. 9, 1982

[54] COILER ARRANGEMENT

[75] Inventors: Johann W. Ferri, Greifensee; Hermann Gasser, Zurich; Paulo Di Benedetto, Uster, all of Switzerland

[73] Assignee: Luwa AG, Zürich, Switzerland

[21] Appl. No.: 130,058

[22] Filed: Mar. 13, 1980

[30] Foreign Application Priority Data

Oct. 1, 1979 [CH] Switzerland ..... 8834/79

[51] Int. Cl.³ ..... B65H 54/80
[52] U.S. Cl. ..... 19/159 R
[58] Field of Search ..... 19/159 R, 159 A

[56] References Cited

U.S. PATENT DOCUMENTS 3,377,665 4/1968 Kincaid ..... 19/159 R
3,736,625 6/1973 Johns ..... 19/159 R

FOREIGN PATENT DOCUMENTS 2721422 11/1978 Fed. Rep. of Germany .... 19/159 R

*Primary Examiner*—Louis Rimrodt
*Attorney, Agent, or Firm*—Werner W. Kleeman

[57] ABSTRACT

A coiler arrangement wherein an infeed connection leads to compaction or pressure rolls, and a mouthpiece of the infeed connection has a sliver outlet opening which is directed towards the roll nip of the pressure or compaction rolls. A compartment which is operatively connected with a negative pressure source and formed in a hood or cover member, surrounds the infeed connection and is bounded by the pressure or compaction rolls in the direction of travel or feed of the sliver. The mouthpiece flow communicates with the compartment by means of openings provided at its circumference, and between these openings and the inner surface of the mouthpiece there are formed guide surfaces.

9 Claims, 3 Drawing Figures

COILER ARRANGEMENT

CROSS-REFERENCE TO RELATED CASE

This application is related to the commonly assigned, U.S. application Ser. No. 130,059, filed Mar. 13, 1980, entitled "Apparatus for the Pneumatic Transport of Textile Band Material."

BACKGROUND OF THE INVENTION

The present invention broadly relates to the textile art and, more specifically, relates to a new and improved construction of coiler arrangement.

Generally speaking, the coiler arrangement comprises a pair of compaction or pressure rolls and a funnel or trumpet wheel arranged following the pair of compaction or pressure rolls, viewed in the direction of travel of the sliver or other filamentary or band-like textile material. The term "sliver" is used therefore in its broader sense to cover slivers, slubbing, roving and so forth.

In the case of coiler arrangements infeed of the starting portion of the sliver, delivered by the card, becomes that much more cumbersome the larger or higher, as the case may be, that the cans are, and therefore, equally the coiler arrangements themselves. Moreover, as a rule larger size sliver cans are usually operatively associated with cards working at higher delivery speeds, so that less time is available, not only for the infeed of the sliver into the roll nip of the compaction or pressure rolls, but equally for the preceding threading-in of the starting portion of the sliver through the compensation path provided with deflection rolls.

SUMMARY OF THE INVENTION

It is a primary object of the present invention to provide a new and improved construction of coiler arrangement wherein the infeed of the starting portion of the sliver into the roll nip can be automatically accomplished.

Yet a further significant object of the present invention aims at a new and improved construction of coiler arrangement which is relatively simple in design, economical to manufacture, extremely reliable in operation, not readily subject to breakdown or malfunction, and is capable of automatically introducing the starting portion of the sliver or other bandlike textile material into the roll nip of a pair of compaction or pressure rolls provided for sliver cans.

Now in order to implement these and still further objects of the invention, which will become more readily apparent as the description proceeds, the coiler arrangement of the present development is manifested by the features that the compaction or pressure rolls delimit and close-off, viewed in the direction of travel of the sliver or the like, a compartment which is connected with a source of negative pressure. An infeed connection, which extends into the compartment, terminates in a mouth or connection piece surrounded by the compartment. The mouthpiece has a sliver outlet or discharge opening directed towards the roll nip of the pressure rolls, and also is provided with openings at its circumference or peripheral region which open into the compartment and possesses guide surfaces for the sliver.

By virtue of the negative pressure prevailing within the compartment there flows an air current in the infeed or delivery connection which is flow connected by means of the openings of the mouthpiece with the compartment. This air current or flow draws the sliver starting portion, located in the infeed connection, into the mouthpiece and owing to the tension force, to which the sliver section or portion following the starting portion thereof is exposed due to the action of the air flow or current, the sliver starting portion is introduced into the roll nip, where it is positively grasped by the driven pressure or compaction rolls. On the other hand, due to the guiding and support of the sliver in the mouthpiece care is taken to ensure that, in particular, the starting portion of the sliver is neither deflected nor damaged by the transporting air current or stream which flows out into the compartment. What is important in this context is that at the sliver outlet opening of the mouthpiece there no longer is present any air flow of significance, and this can be effectively realized by virtue of the openings or holes provided at the circumference of the mouthpiece.

While it is possible to arrange the inlet openings at the infeed or delivery connection or connection means at an easily accessible location of the coiler arrangement, so that the starting portion of the sliver can be manually introduced, it is also possible to connect the infeed connection with a transport tube or pipe, whose inlet opening is directly located at the card. By virtue of the air flow which is generated by the negative pressure source, which in this case not only prevails in the infeed or delivery connection but also in the transport tube, it is thus possible to simplify the transfer of the sliver starting portion into the coiler arrangement and also there are dispensed with the need for deflection elements for the transport of the sliver.

In particular, also in those instances where the transport of the sliver from the card to the coiler arrangement is accomplished pneumatically, it can be advantageous to work with a more intensified air flow for the drawing-in of a new sliver than for the normal sliver transport. To this end there can be used, by way of example, a ventilator having a two-stage suction operation which is employed as the negative pressure source, or it is also possible to arrange, for instance, between the transport tube and the infeed or delivery connection a compressed air injector.

The invention has particular advantage with those types of coiler arrangements in which the funnel wheel is arranged in a rotatable plate or turntable and apart from its own revolving motion together with the rotatable plate also revolves about the axis of the latter. This enables dispensing with the need for imparting a rotational movement to the sliver cans. In this case the infeed or delivery connection can be revolvingly mounted, together with the rotatable plate or turntable, at its portion disposed forwardly of the mouthpiece, in order to render possible the transfer of the sliver arriving at the coiler arrangement, from the axis of the rotatable plate into the axis of the funnel wheel. Preferably, the rotatable plate is covered by a hood member which in conjunction with the rotatable plate or turntable bounds the compartment.

In any event, the invention affords the advantage that dust or other contaminants, which detach from the sliver during its passage through the compaction or pressure rolls, can be withdrawn by the air flow prevailing within the compartment. Escape of the dust and other removed contaminants into the textile hall or otherwise where the textile machines are erected, or deposition of such dust or the like upon parts of the sliver can-compaction arrangement, is thereby effectively precluded.

According to a further preferred constructional embodiment of the invention the mouthpiece tapers in the direction of the sliver outlet opening, in order to obtain a compaction of the sliver which arrives in the sliver can. This tapering or constriction of the mouthpiece is preferably realized by imparting thereto a conical configuration.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
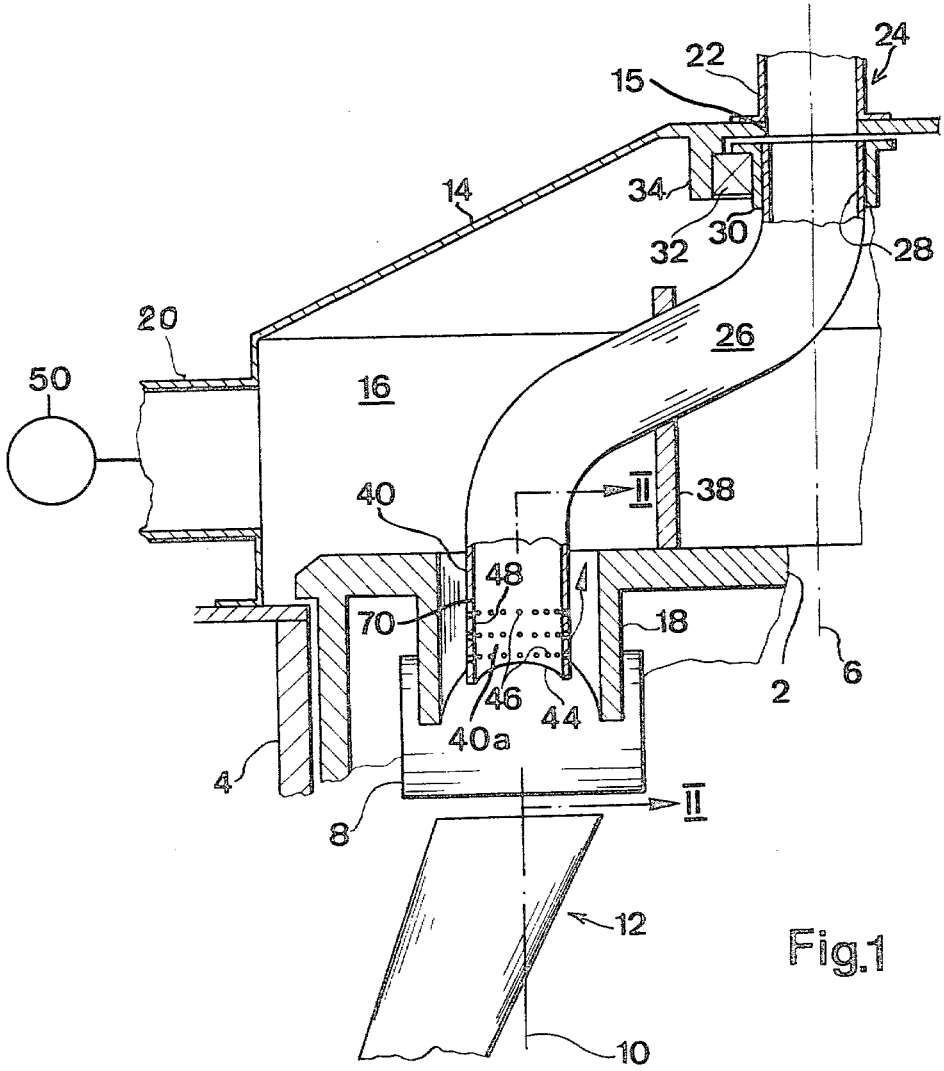
FIG. 1 is a vertical sectional view through the upper portion of a coiler arrangement according to a first exemplary embodiment of the invention.

Describing now the drawings, it is to be expressly understood that only enough of the coiler arrangement has been shown in the drawings in order to enable those skilled in the art to readily understand the underlying principles and concepts of the present development. Turning attention now to FIG. 1, reference character 2 designates a rotatable plate or turntable of a coiler arrangement constructed according to the invention. The rotatable plate or turntable 2 is conveniently mounted in any appropriate fashion to be rotatable within a housing 4 about a substantially vertical axis 6. At the rotatable plate or turntable 2, which is connected with any suitable standard drive device (not shown), there are, firstly, rotatably mounted two coacting pressure or compaction rolls 8 which are rotatable about essentially horizontally dispositioned axes. On the other hand, the rotatable plate or turntable 2 carries, for rotational movement about an axis 10 which is eccentrically disposed with respect to the turntable axis 6, a schematically illustrated funnel or trumpet wheel 12 or equivalent structure. The pressure or compaction rolls 8 and the funnel wheel 12 equally are drivingly connected with the conventional drive device, and the delivery speed of the pressure or compaction rolls 8 corresponds to the speed of movement of the funnel wheel 12 along its path about the axes 6 and 10.

In order to automatically draw-in band-like textile material, here assumed to be sliver which is delivered for instance from a card, into the coiler arrangement, i.e. between the compaction or pressure rolls 8, these pressure rolls 8 together with the rotatable plate or turntable 2 and a hood member 14 bound a compartment or chamber 16. The hood member 14 covers the rotatable plate or turntable 2 and is sealingly attached with the housing 4. To accomplish the automatic threading or drawing-in of the sliver between the pressure rolls 8, the rotatable plate or turntable 2 is advantageously provided with a hollow cylindrical, downwardly directed extension or projection 18 which merges with the surfaces of the pressure rolls 8 and only leaves therebetween a running play. Compartment 16 is connected by means of a conduit or line 20 attached to the hood member 14, with a suitable source of negative pressure, here generally indicated by reference character 50, and specifically constituted, by way of example, as a ventilator or fan which can be operated with two selectable suction stages. Two-stage ventilators or fans suitable for the purposes of the invention are well known in the art. In the arrangement shown, the conduit 20 therefore is connected with the suction side of the ventilator 50.

Continuing, it will be seen that an attachment portion 22 of a delivery or infeed connection 24 is flanged with the hood member 14, and specifically, so as to be coaxially positioned with respect to the rotatable plate or turntable 2. By means of an aperture or opening 15 provided at the hood member 14 the attachment portion 22 is connected with a portion or section 26 which is part of the infeed or delivery connection or connection means 24. The approximately S-shaped connection portion or section 26 possesses an end leg or region 28 which extends essentially coaxially with respect to the rotatable plate or turntable 2, this end leg or region 28 being retained in a suitable bearing arrangement 32, such as a ball bearing, by means of a sealing collar or sleeve 30. The ball bearing or bearing means 32 is arranged in a bearing eyelet or boss 34 provided at the inner surface of the hood or cover member 14. The sealing collar 30 seals the gap between the connection portion or section 26 and the hood member 14.

Figure 2:
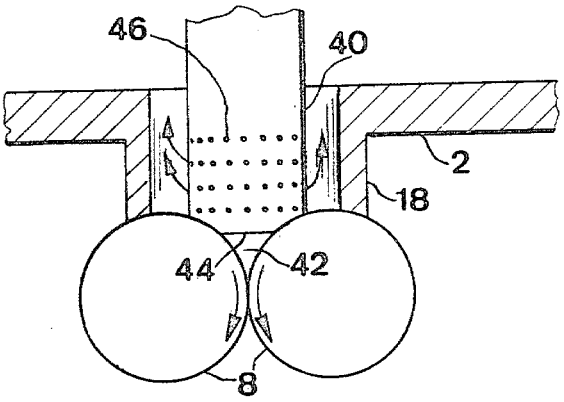
FIG. 2 is a sectional view of the arrangement of FIG. 1, taken substantially along the line II—II thereof.

A second end leg or portion 70 of the section 26, the latter being attached by means of an attachment bracket 38 or equivalent fastening means with the rotatable plate or turntable 2, extends essentially coaxially with respect to the funnel wheel 12. This second end leg or portion 70 contains a mouthpiece 40 and extends, by means of such mouthpiece 40, through the extension or projection 18 directly up to the region of the pressure or compaction rolls 8. The mouthpiece 40 possesses a sliver outlet or discharge opening 44 which is directed into the roll nip or gap, generally indicated by reference character 42 (FIG. 2) of a pair of pressure or compaction rolls 8.

Distributed about the circumference or periphery of the mouthpiece 40 are air outlet openings 46, and between these openings 46 there are formed at the substantially cylindrical inner surface 40*a* of the mouthpiece 40 guide surfaces 48.

With the illustrated exemplary embodiment of coiler arrangement it is to be understood that the same is connected by means of its infeed or delivery connection 24 with a not particularly shown transport tube or pipe extending directly up to the region of the card. If the card is placed into operation and if it begins to deliver a sliver, then also the coiler arrangement and its ventilator 50 are placed into operation at its higher suction stage. Consequently, a transport air flow or current is generated within the transport tube which is connected with the compartment or chamber 16 by means of the infeed or delivery connection 24 and its mouthpiece 40. This transport air current is thus effective in the direction of the coiler arrangement. The sliver starting portion which has been prepared in conventional fashion for introduction into the pair of pressure rolls 8, and which has been manually placed at the inlet opening of the transport tube, is now engaged by the transport air current and automatically presented to the coiler arrangement in that the starting portion of the sliver is introduced into the infeed or delivery connection 24. But also the infeed of the sliver starting portion between the pressure rolls 8 is automatically accomplished. The transport air, flowing into the mouthpiece 40, already practically completely flows out of the mouthpiece 40 into the compartment or chamber 16 before reaching the sliver outlet or discharge opening 44. In this regard it has been found to be important to ensure that the entire cross-sectional area of the openings 46 is greater than the cross-section or cross-sectional area of the mouthpiece 40.

Hence, during the passage of the starting portion of the sliver through the mouthpiece 40 there is effective a tension force which decreases in the direction of the outlet opening 44. However, the kinetic energy which is present at the sliver starting portion and the tension force exerted upon the following portion of the sliver is sufficient in order to move the sliver starting portion into the roll nip 42 and to bring such sliver starting portion into contact with the pressure or compaction rolls 8. By means of the exerted friction between the sliver starting portion and the pressure rolls 8 the sliver starting portion is then seized by the pressure rolls 8 and fed to the funnel wheel 12.

At the latest during this point in time, but if desired already when the sliver starting portion has passed the attachment section or portion 22 of the infeed connection 24, the ventilator 50 can then be switched to its lower suction stage. Upon passage of the sliver through the mouthpiece 40 the sliver starting portion is supported by the guide surfaces 48 for such length of time as there is present an outwardly directed air flow, which otherwise could deflect such sliver starting portion.

Figure 3:
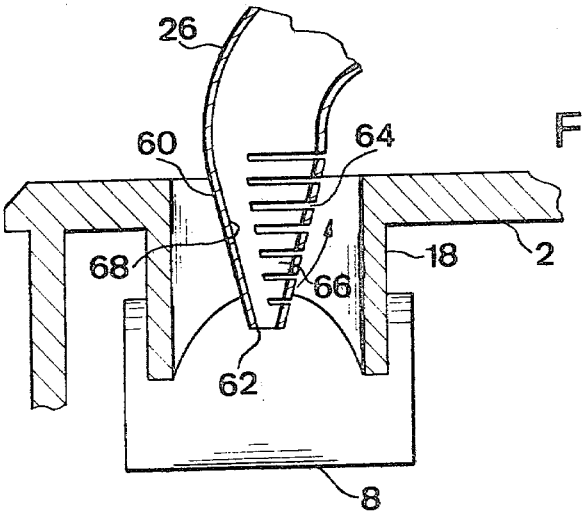
FIG. 3 is a fragmentary vertical sectional view of a second embodiment of the invention.

With the second exemplary embodiment illustrated by way of example in FIG. 3 the mouthpiece, here designated by reference character 60, is structured as a compaction or condenser funnel. This mouthpiece 60 formed, for instance, as a hollow truncated conical portion, possesses a cross-sectional area for its band outlet opening 62 which is appreciably reduced in relation to the cross-sectional area of the infeed connection portion 26. The effect of the mouthpiece 60 upon the prepared, i.e. twisted together and tapered sliver starting portion, is the same as for the mouthpiece 40 discussed above with respect to the embodiment illustrated in FIGS. 1 and 2. The air flows through approximately horizontal slots or exit openings 64, while the sliver can be supported at the guide surfaces 66 of the mouthpiece 60. On the other hand, if the starting portion of the sliver is seized by the pressure rolls 8 and non-compacted sliver enters the mouthpiece 60, then the air assumes the flow path at the side of the mouthpieace 60 which is provided with the slots or openings 64.

Hence, the sliver is supported by the surface 68 of the mouthpiece 60, this surface 68 being located opposite to the air outflow slots 64 and being smooth and free of any openings or interruptions. Notwithstanding the radial compression or pressure action which the mouthpiece 60 exerts upon the sliver, the latter does not become caught within the mouthpiece 60. The compaction of the sliver in the mouthpiece 60 renders it possible to appreciably more intensely fill the sliver cans.

While there are shown and described present preferred embodiments of the invention, it is to be distinctly understood that the invention is not limited thereto, but may be otherwise variously embodied and practised within the scope of the following claims. Accordingly,

What is claimed is:

1. A coiler arrangement for band-like textile materials, such as sliver moving in a predetermined direction of travel, comprising:

means defining a compartment having a sliver outlet side;

means defining a negative pressure source with which there is operatively connected said compartment;

a pair of pressure rolls located at the region of said sliver outlet side of said compartment and through which passes the infed sliver and delimiting and closing-off the compartment in the direction of travel of the sliver;

tubular infeed connection means for the infeed of the sliver to the pair of pressure rolls;

said tubular infeed connection means extending within the compartment and terminating at a mouthpiece surrounded by the compartment;

said pair of rolls defining therebetween a roll nip;

said mouthpiece having sliver outlet opening means directed towards the roll nip of the pair of pressure rolls;

said mouthpiece being provided at its circumference with air exit openings which flow communicate with the compartment;

said mouthpiece possessing guide surface means for the sliver; and said guide surface means serving to support the fibers of the sliver and counteracting sliver expanding forces exerted by the air escaping through the mouthpiece air exit openings.

2. The coiler arrangement as defined in claim 1, wherein:

said mouthpiece is structured to taper in the direction of the sliver outlet opening means.

3. The coiler arrangement as defined in claim 2, wherein:

said tapering of the mouthpiece is essentially conical in configuration.

4. The coiler arrangement as defined in claim 3, wherein:

said air exit openings are formed by slot means which extend approximately in the peripheral direction of the mouthpiece.

5. The coiler arrangement as defined in claim 1, further including:

a rotatable turntable;

a funnel wheel mounted at said rotatable turntable and below said pair of pressure rolls;

said tubular infeed connection means containing a portion incorporating said mouthpiece;

means for rigidly connecting said portion with said rotatable turntable;

said rotatable turntable having an axis of rotation;

said funnel wheel having an axis of rotation; and said portion extending from the axis of rotation of the rotatable turntable to the axis of rotation of the funnel wheel.

6. The coiler arrangement as defined in claim 5, wherein:

said portion comprises two substantially straight end legs which extend essentially mutually parallel to one another;

the lengthwise axis of one of the end legs coinciding with the axis of the funnel wheel and the lengthwise axis of the other end leg coinciding with the axis of the rotatable turntable; and bearing means for supporting the end leg which is arranged substantially coaxially with respect to the rotatable turntable.

7. The coiler arrangement as defined in claim 6, wherein:

said means defining said compartment comprises a hood member;

said bearing means being secured to said hood member;

said hood member together with said rotatable turntable delimiting said compartment; and said tubular infeed connection means including an attachment portion which is connected with said hood member.

8. The coiler arrangement as defined in claim 1, wherein:

said coiler arrangement is used for processing sliver as it travels towards a coiler funnel for sliver coiling.

9. The coiler arrangement as defined in claim 8, wherein:

said coiler arrangement is located upstream of said coiler funnel with respect to the direction of travel of the processed sliver.

* * * * *